United States Patent [19]

Berg

[11] 4,192,261

[45] Mar. 11, 1980

[54] MULTI-CYLINDER RECIPROCATING PISTON INTERNAL COMBUSTION ENGINE

[75] Inventor: Josef Berg, Cologne, Fed. Rep. of Germany

[73] Assignee: Klöckner-Humboldt-Deutz Aktiengesellschaft, Cologne, Fed. Rep. of Germany

[21] Appl. No.: 828,319

[22] Filed: Aug. 29, 1977

[30] Foreign Application Priority Data

Sep. 1, 1976 [DE] Fed. Rep. of Germany ..... 2639260

[51] Int. Cl.[2] ..... F02B 75/26

[52] U.S. Cl. ..... 123/58 B; 92/73; 123/54 R; 123/58 BB; 123/197 AB; 417/539

[58] Field of Search ..... 123/54, 58, 197, 78 F; 92/73; 417/539; 74/60, 25

[56] References Cited

U.S. PATENT DOCUMENTS

| | | | |
|---|---|---|---|
| 1,291,531 | 1/1919 | James et al. | 123/78 F |
| 1,536,262 | 5/1925 | Olivier | 123/58 B |
| 2,387,540 | 10/1945 | Swain | 123/197 R |
| 2,909,164 | 10/1959 | Biermann | 123/78 F |
| 4,092,957 | 6/1978 | Trymorn | 123/78 F |

FOREIGN PATENT DOCUMENTS

| | | | |
|---|---|---|---|
| 455104 | 8/1913 | France | 123/78 F |
| 256310 | 8/1948 | Switzerland | 123/58 R |

*Primary Examiner*—Ira S. Lazarus
*Assistant Examiner*—Craig R. Feinberg
*Attorney, Agent, or Firm*—Becker & Becker

[57] ABSTRACT

A multi-cylinder reciprocating piston internal combustion engine with the cylinders thereof arranged in series in a plurality of rows, which includes a crank shaft with Z-shaped lift pin having rotatably journaled thereon a universal joint. The universal joint includes an outer part with journal pins and an inner part journaled in the outer part and including a hollow shaft having its longitudinal axis extending perpendicular to the axes of the journal pins. The outer part of the universal joint is non-rotatably connected to a double arm rocker having pistons connected thereto through the intervention of connecting rods. The outer part of the universal joint which is journaled in the engine housing extends around the lifting pin in a box or bowl-shaped manner. For each lifting pin, two diametrically arranged double arm rockers, with two pistons each are provided.

13 Claims, 6 Drawing Figures

MULTI-CYLINDER RECIPROCATING PISTON INTERNAL COMBUSTION ENGINE

The present invention relates to a multiple cylinder reciprocating piston internal combustion engine in series construction with a crankshaft having a Z-shaped lift pin on which a universal joint with a hollow shaft is rotatably journaled. The hollow shaft, in a direction perpendicular to the axis of rotation, has diametrically arranged bearing pins on which the other joint part is mounted, the last mentioned joint part being non-rotatably connected to a double rocker to which the pistons are linked through the intervention of connecting rods.

A reciprocable piston internal combustion engine of this type has been disclosed in the periodical "Der Motorwagen" 1927, page 692, FIG. 15. With this known reciprocating piston internal combustion engine each lift pin has associated therewith a rocker with two pistons laterally of the crankshaft. While with this complicated driving mechanism an overall lower height of the reciprocating piston internal combustion engine is obtained, the engine has, however, a greater width. Furthermore, the mass forces created by the pistons, the connecting rods and the rockers which act counter to the gas forces are supported by the bearings of the universal joint in the housing and are conveyed through the universal joint onto the crankshaft so that as a result thereof all crankshaft bearings will be under load.

It is, therefore, an object of the present invention to provide a compactly built reciprocating piston internal combustion engine which utilizes proved structural elements of customary reciprocating piston internal combustion engines and in which the crankshaft will be loaded only by the useful and alternating torque of the internal combustion engine and by the minor centrifugal forces of the crosshead-hollow shaft.

This object and other objects and advantages of the invention will appear more clearly from the following specification in connection with the accompanying drawings, in which.

Figure 5:
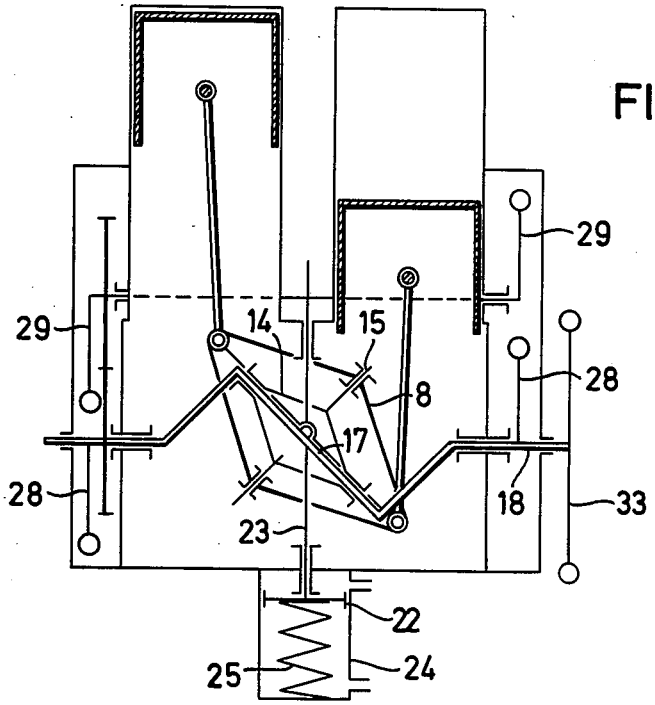

FIG. 5 diagrammatically illustrates the arrangement of the counter and balancing weights and an adjusting device acted upon by a pressure medium.

Figure 1:
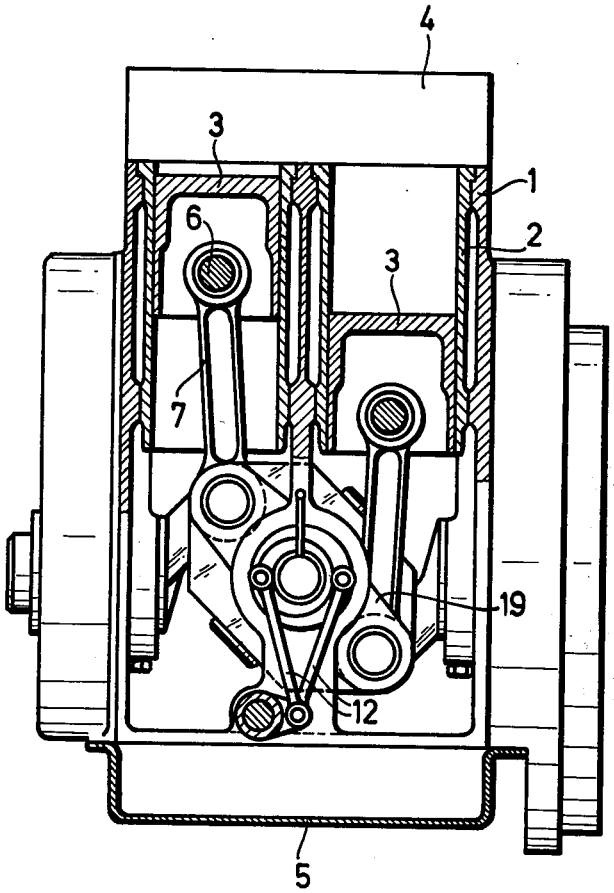
FIG. 1 illustrates a partial vertical longitudinal section through a row of cylinders of an internal combustion engine according to the present invention.
Figure 6:
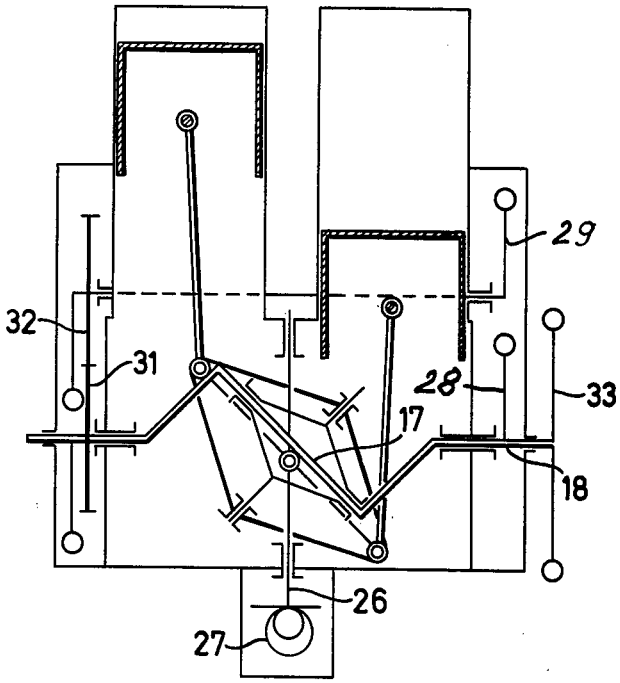

FIG. 6 diagrammatically shows an arrangement similar to that of FIG. 1 but employing a cam as adjusting device.

The reciprocating piston internal combustion engine according to the present invention is characterized primarily in that that portion of the universal joint which is journaled in the housing extends around the lift pin in a box or cup-like manner, is diametrically journaled with regard to the crankshaft, and for each lift pin has two diametrically arranged double rockers with two pistons each.

Due to the design according to the present invention, there can be obtained in its simplest form as four cylinder engine an almost cube-shaped internal combustion engine in which the space as to width as well as to length and height is utilized in an optimum manner. In this instance equal ignition distances are obtained. Furthermore, the rocker with the cup-shaped part of the universal joint can in a simple manner be designed solid and deformation-resistant. Forces, which do not generate a useful torque at the crankshaft, are directly absorbed by the diametrically arranged bearings in the housing. The forces can easily be absorbed by radial bearings of customary design. The crankshaft itself only transmits the useful torque, and due to its shorter length is considerably more torsion-resistant and therefore can be dimensioned correspondingly smaller. A further advantage is seen in the fact that in all bearing areas only radial forces are acting which can be easier harnessed than forces acting in axial direction.

According to a further development of the invention it is suggested that the bearing areas of the universal joint in the housing are adjustable in the direction of the piston movement, and that the universal joint in its bearing areas has so much axial play that the axial movements occuring during the adjustment of the bearing areas in the housing are within the predetermined play.

By adjusting the bearing areas, a change in the compression ratio is obtained inasmuch as the dead space in the working cylinders is increased or decreased. Inasmuch as the bearing areas in the housing are easily accessible, the adjusting devices can be arranged without great expenses. Inwardly located bearings, for instance the bearing of the hollow shaft on the pin, are not changed. They adjust themselves automatically within their axial play with regard to the changed conditions of operation. Deviations from the theoretical ideal position, in which the axes of the universal joint extending perpendicular to each other and the axis of the crankshaft intersect in one point, are compensated for in the bearing areas of the universal joint, for instance of the hollow shaft on the crankpin, by an axial rocking movement, the magnitude of which depends on the magnitude of the deviation. For an effective change of the compression ratio, the axial rocking movements are of structurally acceptable magnitude so that without difficulties a sufficient axial play of the bearings can be provided. This axial play likewise absorbs the movements which are caused by the machining tolerances.

The change in the compression ratio is desirable in many instances in order to be able to better adapt the behavior of operation of the internal combustion engine to the respective requirements. Thus, it is for instance possible to operate highly supercharged internal combustion engines which when under full load will in all load ranges have the same peak pressures and loads on the driving mechanisms, and which by increasing the combustion ratio during the starting and speed increasing phase show a good starting behavior. For improving the starting behavior it is expedient to speed up the internal combustion engine to its optimum starting speed at a minimum compression ratio and then to shift over to the high starting compression ratio. This creates the effect of a decompression device.

According to a further development of the invention, it is suggested that at about half the stroke of the pistons, the crankshaft and/or the universal joint partially immerse in lateral recesses of the rockers. As a result thereof, the width of the internal combustion engine can be reduced. Moreover short distances are obtained between the power attack points and the bearing areas so that the moments to be conveyed by the structural elements can be held low.

According to a still further development of the invention, for obtaining a simple adjustment of the compression ratio, it is suggested that the universal joint is journaled in two counter rotatable eccentric sleeves. If the bearing arranged in the inner sleeve is non-rotatably supported by the housing, equal torques will be generated in both eccentrics under load, which torques cancel each other out during counter rotation. Thus, free from holding forces, at any desired adjustment only the respective frictional moments in the adjusting device are to be overcome. Another adjusting possibility consists in that the bearings of the universal joint at the side of the housing are adapted to be fixed by means of a cam adapted to be arrested. A further development of the invention comprises a hydraulic or pneumatic adjusting possibility according to which the bearings located on the housing side and pertaining to the universal joint are adjustable by means of a spring-loaded hydraulically or pneumatically actuated working piston. In this connection, the spring may be so arranged that, in addition to returning the working piston, it also serves for limiting the maximum ignition. In this instance the spring is expediently made adjustable. It is a matter of course that also other adjusting elements of the control art, for instance mechanically, hydraulically, or electrically actuated levers or buckling systems, coulisses with cams or keys, screw drives, or directly acting working cylinders, can be utilized which permit a synchronous adjustment of the cooperating bearing areas.

The adjustment of the bearings on the housing side is, according to a further development of the invention, expediently effected by a control device and adjusting elements by means of which the bearings located at the housing side and pertaining to the universal joint are adjusted in conformity with the respective parameters of operation of the internal combustion engine, for instance a critical temperature of a structural element, the exhaust gas temperature, the ignition pressure, the speed of rotation, the load, the suction pressure, the charging pressure, etc.

With the internal combustion engine according to the present invention mass moments are caused by pistons, connecting rods and rockers, which, combined by the rockers, together counteract the gas forces so that the universal joint is subjected only to the useful and alternating torque. All mass forces are expediently, in conformity with a further development of the invention, compensated for by counter weights on the crankshaft in cooperation with two counter turning compensating weights so that free mass forces will no longer occur. Equivalent to the rotating counter weights are pendulum weights which are arranged on or in the internal combustion engine.

Referring now to the drawings in detail, the internal combustion engine illustrated therein comprises a machine housing 1 having inserted therein cylinders 2 in which pistons 3 are axially displaceable. The cylinders 2 are at one end of their end faces closed by cylinder heads 4 in which in customary manner there are provided gas change passages and control elements, not illustrated. A lubricating oil pan 5 closes the engine housing at the lower end thereof.

The pistons 3 are by means of gudgeon pins 6 and connecting rods 7 linked to a double rocker 9 which forms one piece with the outer part 8 of a universal joint. The part 8 is pivotally mounted in adjustable bearings 9a. These bearings 9a are formed by two eccentric sleeves 10 and 11 which are rotatable in counter direction with regard to each other. For purposes of a synchronous adjustment, connecting rods 12 are linked to the end faces of the eccentric sleeves 10 and 11. The connecting rods 12 are actuated by means of a crank 13 journaled in the housing. Instead of the crank 13, other adjusting means of an automatic control device may be provided. By a synchronous turning of the eccentric sleeves 10 and 11 the bearings 9a are adjusted in the direction of movement of the pistons 3.

In the outer part 8 of the universal joint there is journaled an inner part 14 of the universal joint with bearing pin 15. The axes of the bearing pins 15 extend at a right angle with regard to the axes of the bearings 9a. The inner part 14 of the universal joint furthermore comprises a hollow shaft 16 which extends vertically with regard to the axis of the bearing pin 15. The hollow shaft 16 is journaled on a Z-shaped lift pin 17 of a crankshaft 18 journaled in the housing 1. The hollow shaft 16 has such a great axial play that, when adjusting the bearings 9a in the direction of movement of the pistons 3, the hollow shaft 16 can be axially freely displaced on the lift pin 17 within the adjusting path without engaging the crank web of the crankshaft 18.

Figure 2:
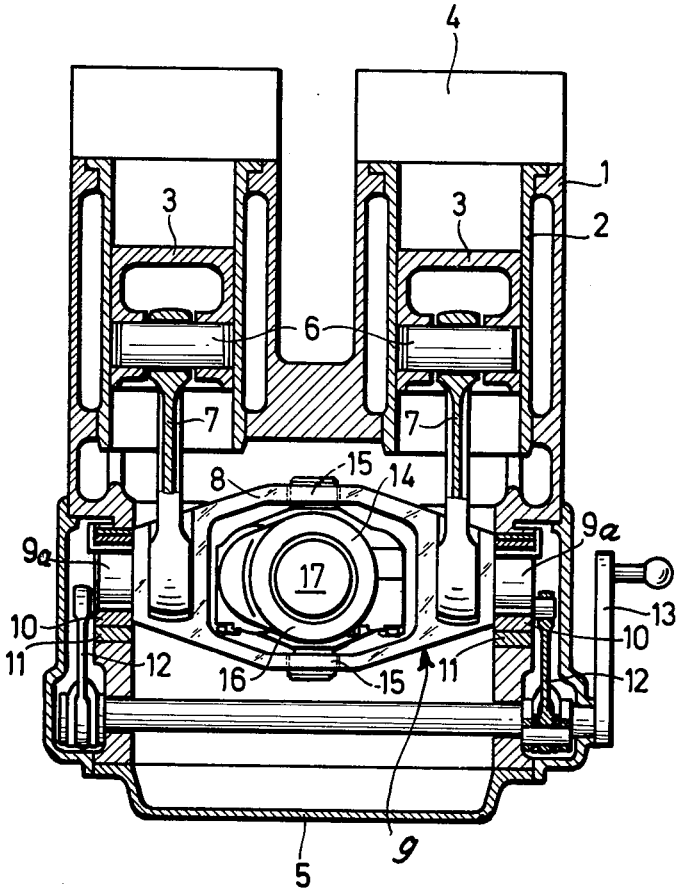
FIG. 2 illustrates a cross section through two oppositely located rows of cylinders of an internal combustion engine according to the invention.
Figure 3:
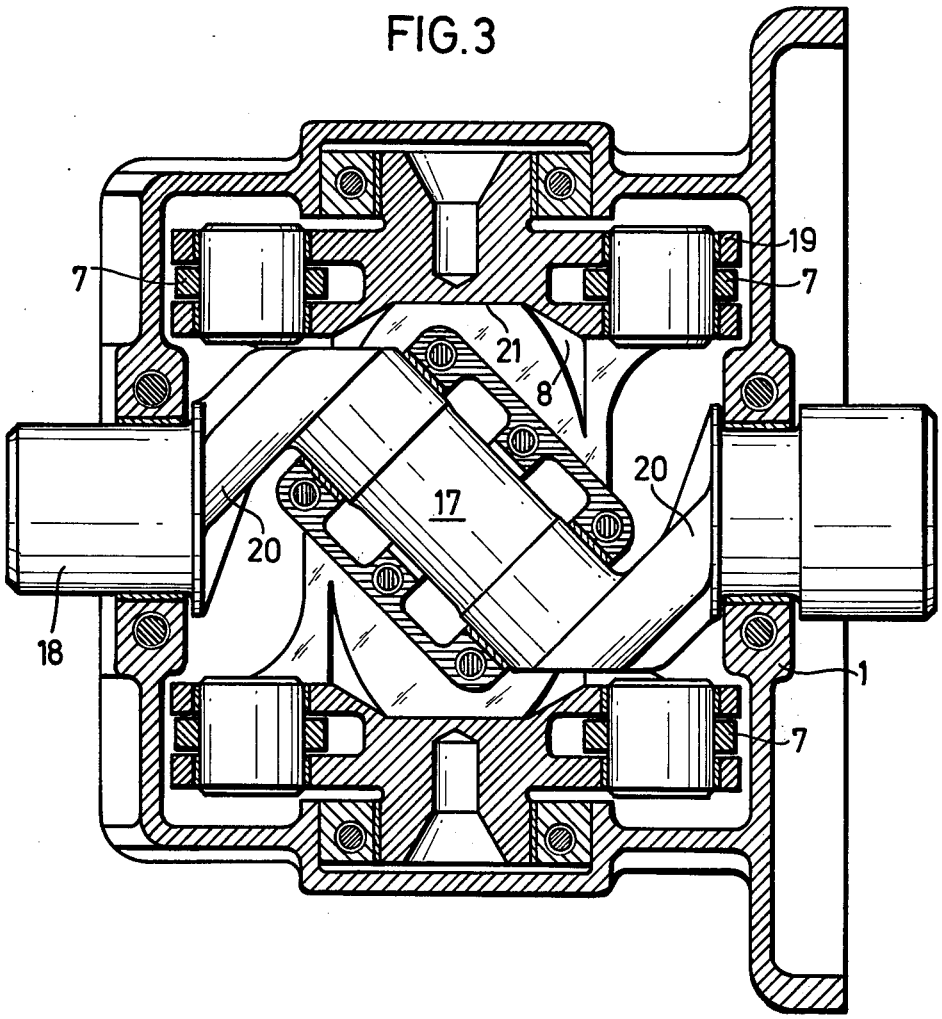
FIG. 3 represents a horizontal longitudinal section at the level of the crankshaft axis.
Figure 4:
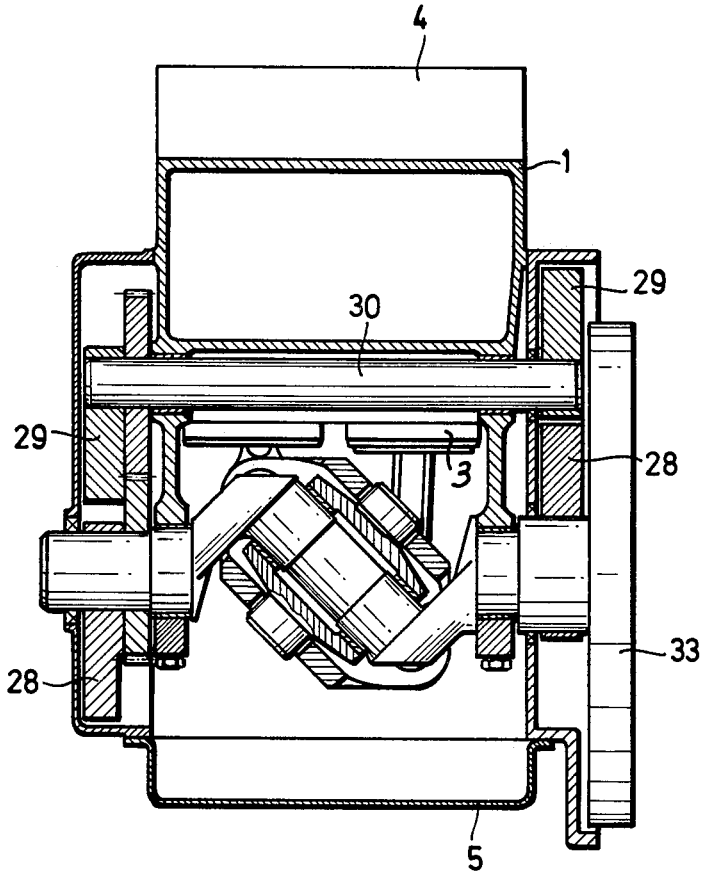
FIG. 4 is a vertical longitudinal section through the axis of the crankshaft.

As will be evident from FIG. 2, the outer part 8 of the universal joint which part 8 is connected to the double rockers 19 extends around the lift pin 17 in a box-like manner and thus results in a very strong and deformation resistant structural element which is adapted to absorb high forces. The double rockers 19 have lateral recesses 21 into which the universal joint 8 partially extends when the pistons 3 have performed half of their stroke. The recesses 21 make it possible to move the rows of cylinders and the points of attack of the forces rather close to each other so that a compact and light structure will be obtained.

Instead of adjusting the bearings 9a by means of two eccentric sleeves 10 and 11, it is also possible to act upon the working pistons 22 by hydraulic or pneumatic means. The pistons 22 engage the bearings 9a by means of piston rods 23 and are adapted to be axially displaced in the working cylinders 24. The axial pistons are at one end face under the load of springs 25 which adjust the bearings 9a in the direction toward the maximum compression ratio. Without additionally being acted upon by a pressure medium, the springs 25 act as ignition pressure limiting means while, due to the stiffness of the springs, the maximum ignition pressure can be predetermined. In such an instance it is expedient to dampen the movement of the working piston 22, for instance by means of a throttle. If the working piston 22 is acted upon by a pressure medium, a fixed compression ratio can be set which can be adapted to an optimum degree to the respective conditions of operation.

The bearings 9a can furthermore by pushrods 26 and by means of an arrestable cam 27 be displaced accordingly (FIG. 6).

For compensating the mass forces, the crankshaft is provided with counter weights 28 which cooperate with counter running balancing weights 29. The balancing or compensating weights 29 are connected to a shaft 30 which is journaled in the housing 1 between the cylinder rows and is driven in counter direction by the crankshaft 18 through the intervention of gears 31 and 32. Also connected to crankshaft 18 at one end thereof is a flywheel 33.

It is, of course, to be understood that the present invention is by no means limited to the specific showing in the drawings, but also encompassses any modifications within the scope of the appended claims.

What I claim is:

1. A multi-cylinder reciprocable piston internal combustion engine with the cylinders thereof arranged in series in a plurality of rows, which comprises in combination: a housing having bearings, a crank shaft with Z-shaped lift pin journaled rigidly in said housing, a universal joint having adjustable trunnions journaled in said housing bearings, said universal joint comprising an outer part arranged within said housing and provided with journal pins, said universal joint also comprising an inner part journaled in said outer part by means of said journal pins, said inner part of said universal joint including a hollow shaft having its longitudinal axis extending perpendicular to the axes of said journal pins and being journaled on said Z-shaped lift pin, a double arm rocker journaled in the housing transverse to cylinder axes and having said outer part integrally non-rotatably connected thereto, pistons, connecting rods pivotally connected to said pistons and connecting the latter to said double arm rocker, said outer part extending around said lift pin and being located diametrically with regard to said crank shaft, all piston forces and mass forces being transmitted directly into the housing by way of the double arm rocker so that the universal joint takes up only the resulting torque forces taken off from the crank shaft.

2. An engine in combination according to claim 1, in which said rocker has lateral recesses, and in which within the central area of the piston stroke the crank shaft partially enters said recesses.

3. An engine in combination according to claim 1, in which said rocker has lateral recesses, and in which within the central areas of the piston stroke the universal joint partially enters said recesses.

4. An engine in combination according to claim 1, in which said housing bearings are adjustable for adjusting said trunnions and for each housing bearing include two eccentric sleeves rotatable in opposite direction with regard to each other.

5. An engine in combination according to claim 1, which includes arrestable cam means for selectively adjusting said housing bearings for the trunnions of said universal joints.

6. An engine in combination according to claim 1, which includes pendulum weights for equalizing reciprocable masses in said engine.

7. An engine in combination according to claim 1, which includes at least rectilinearly arranged four cylinders with pistons reciprocable therein, and in which for each lift pin there are provided two diametrically arranged double-arm rockers with two pistons.

8. An engine in combination according to claim 7, in which said adjustable trunnions are adjustable in the direction of movement of said pistons, the play between said housing bearings and said trunnions of said universal joint being such that the axial movements occurring in said housing when adjusting said trunnions are within said play.

9. An engine in combination according to claim 1, which includes control means and adjusting means for adjusting said housing bearings for said trunnions in conformity with selected parameters of said engine.

10. An engine in combination according to claim 9, in which said control means is operable in response to the obtainment of the starting speed to shift the compression ratio over from its minimum compression ratio to its starting compression ratio.

11. An engine in combination according to claim 1, which includes two counterweights arranged on said crank shaft for balancing mass forces and mass moments, and which also comprises two balance weights rotatable in counter running direction with regard to each other and operable to cooperate with said counter weights.

12. An engine in combination according to claim 11, which includes a shaft arranged between two cylinder rows, and in which said balance weights are arranged on said last mentioned shaft.

13. An engine in combination according to claim 12, in which said last mentioned shaft is journaled between said rows of cylinders, and which includes gear means drivingly connected to said crank shaft for driving said balance weight in opposite direction with regard to each other.

* * * * *